US006167824B1

(12) United States Patent
Tomita

(10) Patent No.: US 6,167,824 B1
(45) Date of Patent: Jan. 2, 2001

(54) SEWING MACHINE HAVING WORK HOLDER

(75) Inventor: Shintaro Tomita, Nagoya (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/597,279

(22) Filed: Jun. 19, 2000

(30) Foreign Application Priority Data

Jun. 21, 1999 (JP) ..... 11-174200

(51) Int. Cl.[7] ..... D05B 19/12; D05B 21/00; D05C 7/00

(52) U.S. Cl. ..... 112/102.5; 112/475.19; 700/138

(58) Field of Search ..... 112/102.5, 470.01, 112/470.06, 475.19, 277; 700/138

(56) References Cited

U.S. PATENT DOCUMENTS 5,284,104 * 2/1994 Hori et al. ..... 112/103 X 5,899,158 * 5/1999 Yoshida et al. ..... 112/470.01

* cited by examiner

*Primary Examiner*—Peter Nerbun
(74) *Attorney, Agent, or Firm*—Oliff Berridge, PLC

(57) ABSTRACT

A sewing machine calculates a standard sewing speed N to the Pth stitch, and a position of the Pth stitch. When the Pth stitch point is in a first area within a work holder, the sewing speed is determined to be N rpm. In a second area, it is determined to be N-100 rpm. In a third area, it is determined to be N-200 rpm. The distance from the first area to the connecting part of a work holder driving mechanism is the shortest. The distance for the second area is the next. The distance for the third area is the longest. Therefore, the larger the damping by the movement of the work holder is, the slower the sewing speed is set to. The sewing speed for each stitch created by the stitch formation mechanism can be set as fast as possible so that the damping is substantially settled. Thus, the quality of sewing can be secured and the entire sewing speed can be increased, thereby reducing the sewing time.

30 Claims, 12 Drawing Sheets

Fig. 5

| STITCH LENGTH (mm) | STANDARD SEWING SPEED N (rpm) |
|---|---|
| ~ 2.0 | 600 |
| 2.0 ~ 4.0 | 500 |
| 4.0 ~ 6.0 | 400 |
| 6.0 ~ | 300 |

Fig. 6

| AREA | ADJUSTMENT VALUE |
|---|---|
| FIRST | 0 |
| SECOND | 100 |
| THIRD | 200 |

SEWING MACHINE HAVING WORK HOLDER

BACKGROUND OF THE INVENTION

1. Field of Invention

The invention relates to a sewing machine capable of forming a pattern that determines a sewing speed of a sewing device for each stitch or a plurality of stitches based on stitch points in a sewing area of a work holder.

2. Description of Related Art

A conventional sewing machine capable of embroidering includes a stitch formation mechanism that forms a stitch by synchronizing a needle and a loop taker, an embroidery frame that holds a work cloth detachably, and an embroidery frame driving mechanism that mounts the embroidery frame thereon and moves it in two different directions. The stitch formation mechanism and the embroidery frame driving mechanism are driven based on sewing data that specifies the movement direction and movement amount of the embroidery frame for each stitch of an embroidery pattern, so that the pattern is embroidered on the work cloth attached to the embroidery frame.

During sewing, the embroidery frame starts moving at the time the needle comes out from the work cloth, and stops moving at the time the needle penetrates the work cloth. In other words, while the needle is positioned above the work cloth, the embroidery frame is moved for one stitch.

A sewing machine capable of embroidering is designed to hold the embroidery frame at one end and move it in the two different directions. Just after the embroidery frame stops, damping of oscillations of the embroidery frame caused by the change of inertia begins. It takes some time (damping time) until the damping is substantially completed.

When the damping continues, the needle may not penetrate the work cloth at a designated stitch point, which deteriorates the quality of sewing. Because of the damping, the embroidery frame oscillates 1–2 mm in some cases. If the needle penetrates the work cloth under this condition, the embroidery pattern is not formed correctly. Therefore, it is necessary to set the sewing speed of the stitch formation mechanism in consideration of the damping time as well as the moving time of the embroidery frame.

FIG. 14 is a time chart showing a correlation between the height of the needle point and the movement amount of the embroidery frame. In this chart, t1 is the time taken from the start point where the embroidery frame starts to move to the point S where the frame stops moving, and t2 is the time taken from the point S where the damping occurs to the point d where the damping is substantially settled. In this case, it is necessary to set the sewing speed (the speed the needle bar is driven) so that the time in which the point of the needle is positioned above the work cloth is (t1+t2) or more.

The conventional sewing machines are generally provided with at least two embroidery frames, a large size and a small size. An operator changes them according to the size of the work cloth: the large frame is used for embroidering a large pattern on a comparatively large cloth, and the small embroidery frame for embroidering a small pattern on a comparatively small cloth.

However, the large frame is less stiff than the small frame. If the frames are moved at the same speed for the same distance, as shown in FIG. 15, time t3 that is the damping time for the large frame, indicated with a solid line, becomes longer than time t4 that is the damping time for the small frame indicated with a chain line. Furthermore, the conventional sewing machines set the sewing speed for the large frame and the longer damping time so as to ensure an adequate damping time no matter which frame is used. When the small frame is used, the embroidery frame is moved at a slower speed than the embroidery frame could be moved.

The sewing machine capable of embroidering for home use especially, which is designed to hold the embroidery frame at one end and move it in the two different directions, has the following problem regardless of the size of the embroidery frame: when the distance between the connecting portion of the frame to be connected to the embroidery device and a stitch point to be positioned in the embroidery frame becomes longer, the damping time at the stitch point is apt to lengthen, under the influence of the deflection due to inertia during moving.

To maintain the quality of sewing using conventional sewing machines, the sewing speed should be set in consideration of the longest damping time to occur in the embroidery frame. In other words, embroidering proceeds with the sewing speed in consideration of the longest damping time even in a stitch point where the damping time is very short. Therefore, it is impossible to raise the overall speed.

SUMMARY OF THE INVENTION

The invention provides a sewing machine with a pattern forming function that can increase the overall sewing speed and maintain the quality of sewing.

In various exemplary embodiments, a sewing machine according to the invention capable of forming a pattern on a work cloth may include a stitch formation device that forms a stitch by synchronizing a needle and a loop taker, a work holder that holds the work cloth, a work holder driving device that moves the work holder in two different directions holding the work holder at one end, the work holder being detachably attached the driving device on a connecting portion thereof, a calculating device that calculates a distance between the connecting portion and a stitch point based on sewing data, a speed determination device that determines a sewing speed of the stitch formation device so that the sewing speed decreases as the distance increases and increases as the distance decreases, and a controller that controls the stitch formation device based on the sewing speed determined by the speed determination device.

In conventional sewing machines, there exists a problem that when the distance between the connecting portion of the embroidery frame to be connected to the embroidery device and a stitch point to be positioned in the work holder becomes longer, the damping time at the stitch point is apt to lengthen, under the influence of the deflection due to inertia during moving.

For various exemplary embodiments of the sewing machine according to the invention, the calculating device calculates a distance between the connecting portion and a stitch point based on sewing data. The speed determination device determines a sewing speed of the work holder driving device so that the sewing speed decreases as the distance increases. Then, the controller controls the stitch formation device based on the sewing speed determined by the speed determination device.

Therefore, the sewing speed for each stitch created by the stitch formation device can be set as fast as possible based on the distance between the connecting portion and the stitch point so that while the needle is above the work cloth, the work holder can be moved for a stitch and the damping is substantially settled. Thus, the quality of sewing can be maintained and the overall sewing speed can be increased, thereby reducing the sewing time.

In an exemplary embodiment of the sewing machine according to the invention, the speed determination device calculates a predetermined number of speed data for a predetermined number of stitch points and determines the sewing speed for the predetermined number of stitch points by the minimum value among the predetermined number of speed data Therefore, as the sewing speed is determined every predetermined number of stitches, the stitch formation device can follow the change of the speed. Further, as the speed of the stitch formation device is not changed too frequently, it can perform sewing smoothly.

In another exemplary embodiment of the sewing machine according to the invention, the sewing machine capable of forming a pattern on a work cloth may include a stitch formation device that forms a stitch by synchronizing a needle and a loop taker, a work holder that holds the work cloth, a work holder driving device that moves the work holder in two different directions holding the work holder at one end, the work holder being detachably attached thereto on a connecting portion thereof, a speed determination device that determines a sewing speed of the stitch formation device by the determination of which divided area includes a stitch point, each divided area being divided out from a whole sewing area surrounded by the work holder, and a controller that controls the stitch formation device based on the sewing speed determined by the speed determination device.

For the exemplary embodiment of the sewing machine according to the invention described above, the speed determination device determines a sewing speed of the stitch formation device by the determination of which divided area includes a stitch point. Then, the controller controls the stitch formation device based on the sewing speed determined by the speed determination device. Therefore, the sewing speed for each stitch created by the stitch formation device can be set as fast as possible by determining which divided area includes a stitch point so that while the needle is above the work cloth, the work holder can be moved for a stitch and the damping is substantially settled. Thus, the quality of sewing can be maintained and the overall sewing speed can be increased, thereby reducing the sewing time.

In another exemplary embodiment of the sewing machine according to the invention, the sewing machine may further include an adjustment value obtaining device that obtains an adjustment value determined for each divided area. The speed determination device determines the sewing speed based on a standard sewing speed and the adjustment value. Therefore, the sewing speed can be determined using a standard sewing speed and the adjustment value by a simple manner.

In another exemplary embodiment of the sewing machine according to the invention, the sewing machine may further include a standard speed obtaining device that obtains the standard sewing speed determined by a stitch length. Therefore, the sewing speed is set for each stitch or a group of stitches based on a stitch length which is obtained from the sewing data (that is, the movement amount of the work holder). When the stitch length is long, the sewing speed is reduced; when the stitch length is short, the sewing speed is increased. In both cases, the work holder is efficiently moved for a stitch while the needle is positioned above the work cloth.

In another exemplary embodiment of the sewing machine according to the invention, the adjustment value may be set so that the longer a distance between each divided area and the connecting portion is, the lower the determination device determines the sewing speed. Therefore, the sewing speed for each divided area can be determined in a simple manner.

In another exemplary embodiment of the sewing machine according to the invention, the speed determination device determines the sewing speed by subtracting the adjustment value from the standard sewing speed. Therefore, the sewing speed can be determined by a simple calculation using the standard sewing speed and the adjustment value.

In another exemplary embodiment of the sewing machine according to the invention, each divided area is divided out from the whole sewing area based on a distance from the connecting portion.

BRIEF DESCRIPTION OF THE DRAWINGS

Various exemplary embodiments of the invention will be described in greater detail with reference to the accompanying drawings wherein;

FIG. 5 is a standard sewing speed look-up table;

FIG. 6 is an adjustment value look-up table;

DETAILED DESCRIPTION OF PREFERRED EMBODIMENTS

Various exemplary embodiments of the invention will be described in detail with reference to the accompanying drawings. The various exemplary embodiments of the invention will be described embodied in an electronically controlled sewing machine having a pattern forming device that is detachably attached to a bed.

Although the invention is described as embodied in an electronically controlled sewing machine having a pattern forming device, it should be appreciated that the invention is applicable to an electronically controlled sewing machine having a pattern sewing or forming device that forms a pattern or patterns, for example, a buttonhole, using, for example, a utility stitch or a zig-zag stitch.

Figure 1:
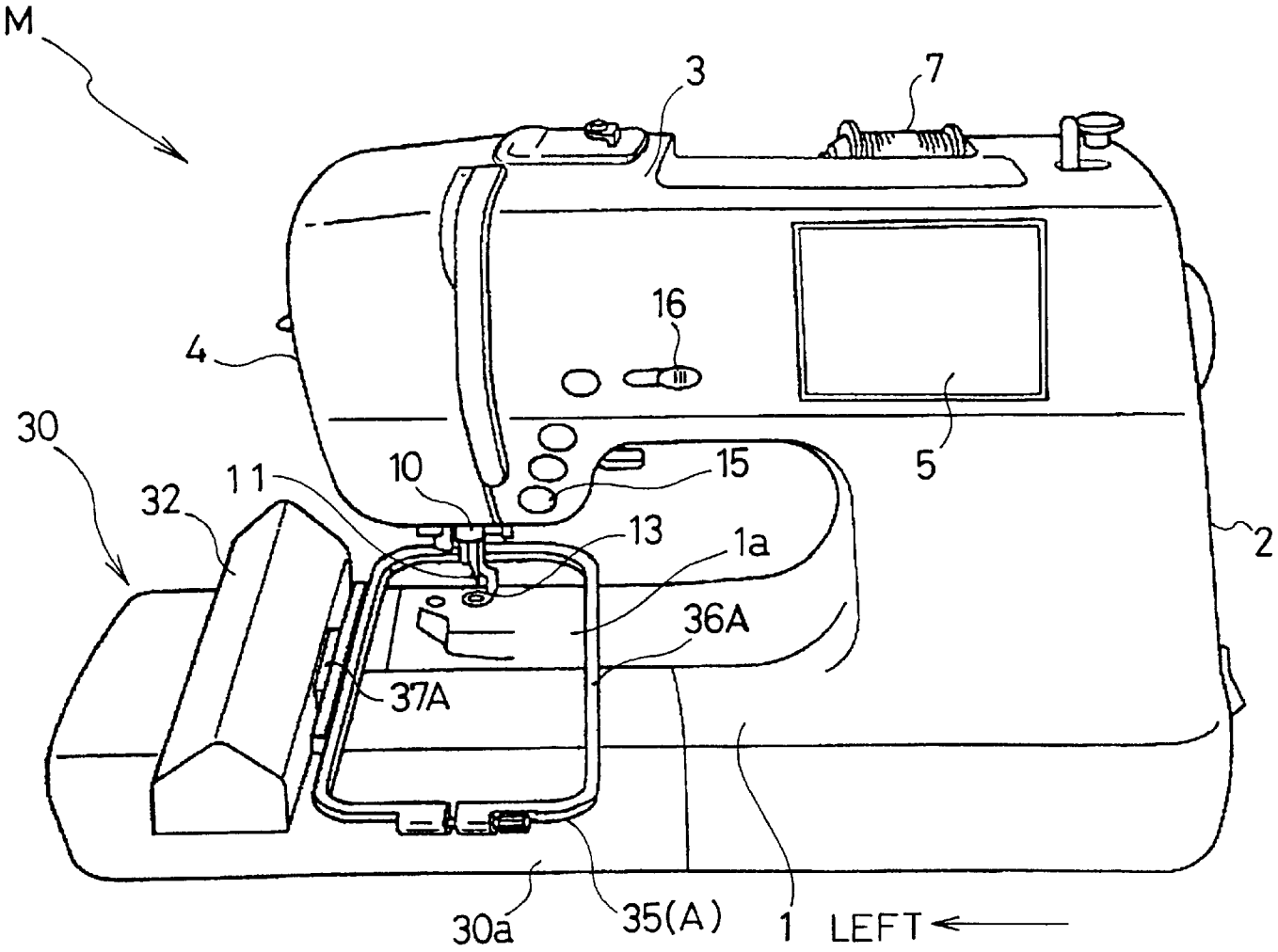
FIG. 1 is a perspective view of an exemplary embodiment of an electronically controlled sewing machine according to the invention.

As shown in FIG. 1, an electronically controlled sewing machine M has a bed 1, a standard portion 2 that stands adjacent to the bed 1, an arm 3 extending from the upper part of the standard portion 2 in parallel with the bed 1, and a machine head 4 positioned at an end of the arm 3. An embroidery device 30 is detachably attached to the bed 1. An embroidery frame 35, or other work holder, holding a work cloth is attached to the embroidery device 30, enabling embroidering on the work cloth held in the frame 35.

When the embroidery device 30 is removed from the bed 1, normal sewing such as straight stitching and zigzag stitching is available.

A needle plate 1*a* is provided on the bed 1. A rotary hook (or loop taker, not shown) is provided inside the bed 1 under the needle plate 1*a*. A display, such as a liquid crystal display (LCD) 5, is mounted on the front right of the arm 3. A plurality of touch keys 6 (FIG. 2), which are transparent electrodes, are arranged on a grid on the LCD 5. On the top of the arm, a spool 7 is placed behind the LCD 5.

A needle bar 10 is provided in the machine head 4 so as to move up and down, and a needle 11 is attached to the bottom of the needle bar 10. A presser foot 13 is provided near the needle 11. The presser foot 13 has a ring on the bottom so that the needle 11 enters the ring. On the front surface of the arm 3 and the machine head 4, a start/stop switch 15 and a speed slider 16 are provided. In this embodiment, the speed slider 16 that can adjust the sewing speed does not function during embroidering. The sewing speed is calculated at a speed calculating process described later.

Figure 2:
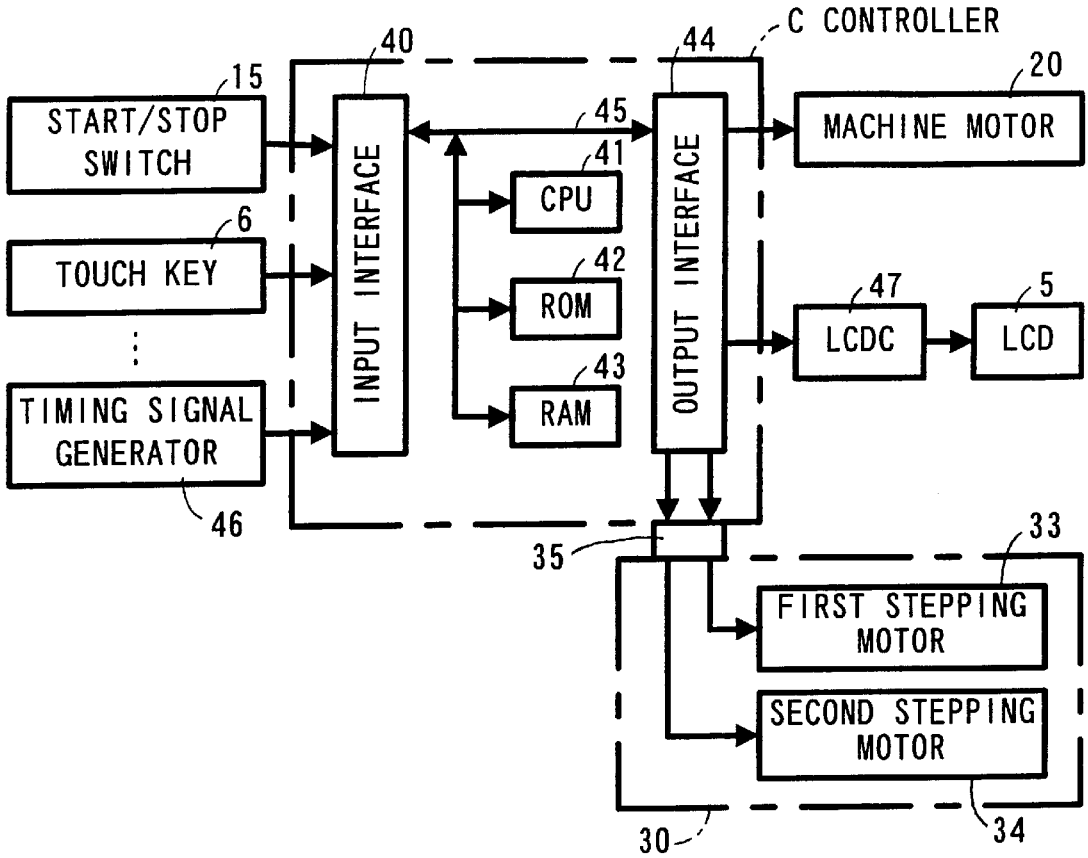
FIG. 2 is a block diagram showing a control system of the sewing machine as shown in FIG. 1.

A needle bar driving mechanism that moves the needle bar 10 up and down, a rotary hook driving mechanism that rotates the rotary hook, and a thread take-up driving mechanism that moves a thread take-up up and down in a timed relation with the up and down motion of the needle bar 10, are further provided. These mechanisms act as a stitch formation device. The needle 11 attached to the needle bar 10, the thread take-up, and the rotary hook are synchronized, so that stitches are formed. These mechanisms are driven by a machine motor 20 (FIG. 2).

The embroidery device 30 comprises a casing 30*a*, the embroidery frame 35 holding the work cloth, a movable member 32 having a Y direction driving mechanism that moves the embroidery frame 35 in the Y direction (backward and forward), and an X direction driving mechanism, included in the casing 30*a*, that moves the movable member 32 in the X direction (leftward and rightward). The X direction driving mechanism is driven by a first stepping motor 33, and the Y direction driving mechanism is driven by a second stepping motor 34 (FIG. 2). The X direction driving mechanism and the Y direction driving mechanism act as an embroidery frame driving device.

Figure 3:
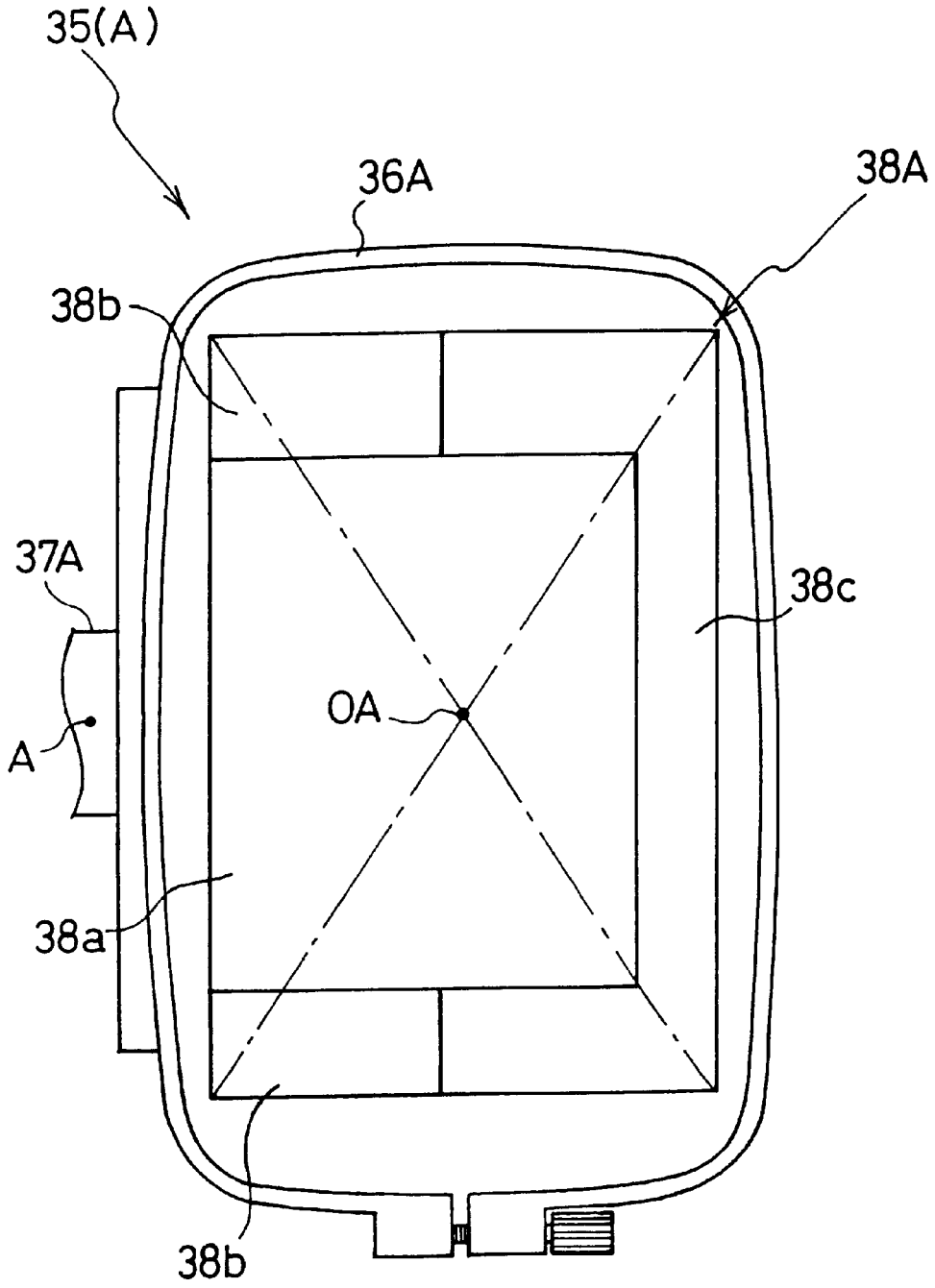
FIG. 3 is a plan view of a large embroidery frame.
Figure 4:
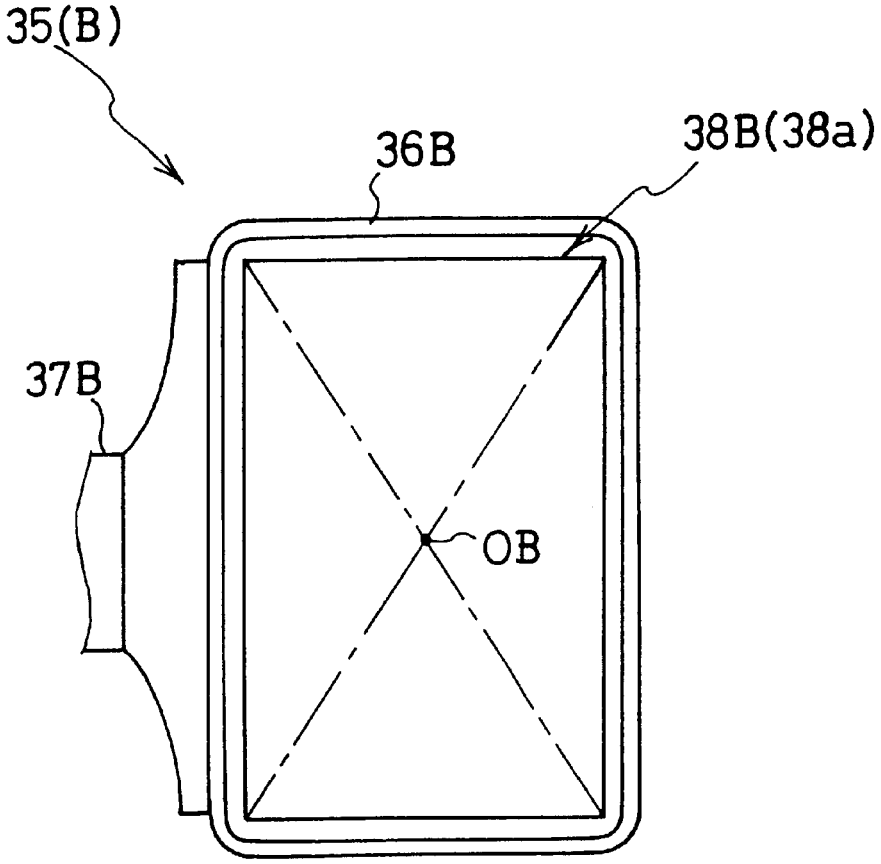
FIG. 4 is a plan view of a small embroidery frame.

The sewing machine M, as shown in FIGS. 3 and 4, has a large embroidery frame 35A and a small embroidery frame 35B. The large frame 35A comprises a rectangular frame 36A, and a connecting portion 37A extending from the middle of the left side of the rectangular frame 36A. Similarly, the small frame 35B comprises a rectangular frame 36B, and a connecting portion 37B extending from the middle of the left side of the rectangular frame 37B.

Each of the connecting portions 37A and 37B is connected to the Y direction driving mechanism which is placed inside the movable member 32, and each of the frames 35A and 35B is mounted above the bed 1. With the embroidery device 30 not in operation, the center OA of the frame 35A and the center OB of the frame 35B are in the same position. Reference numbers 35, 35A, and 35B related to embroidery frame of the sewing machine M will be selectively used to describe the frame as the occasion demands.

Next, the control system of the sewing machine M will now be described.

As shown in FIG. 2, a controller C has an input interface 40, a CPU 41, a ROM 42, a RAM 43, and an output interface 44, which are connected to each other on a bus 45, such as a data bus.

The start/stop switch 15, a plurality of touch keys 6, and a timing signal generator 46 that detects the rotation phase of a main shaft of the sewing machine M, are connected to the input interface 40. The machine motor 20 and a display controller (LCDC) 47 for the LCD 5 are connected to the output interface 44. The first and second stepping motors 33 and 34 of the embroidery device 30 are connected to the output interface 44 via a connector 35. When the embroidery device 30 is attached to or removed from the bed 1, the first and second stepping motors 33 and 34 are connected to or disconnected from the controller C.

The ROM 42 stores pattern data for the embroidery patterns (including sewing data that defines the movement direction and amount of the embroidery frame 35 for each stitch); a control program for selecting a desired embroidery pattern from a plurality of embroidery patterns; and speed information that defines the sewing speeds of the stitch formation device (the driving speeds of the machine motor 20) in areas 38*a*, 38*b*, and 38*c*, which are previously divided from the sewing area 38A in the frame 35A as shown in FIG. 3.

The ROM 42 further includes the following control programs: a stitch point calculation process program for calculating a position of a stitch point for each stitch based on the sewing data for the embroidery pattern to be sewn, a speed determination process for determining in which area 38*a*, 38*b*, or 38*c* the calculated stitch point is placed and for determining the sewing speed of the stitch formation device based on the position of the stitch point found and the adjustment value; a speed control program for adjusting the sewing speed of the stitch formation device so that it can be the same with the sewing speed determined in the speed determination process.

FIG. 3 shows the sewing area 38A in the embroidery frame 35A. Viewing the distance from a reference point A in the connecting portion 37A, which is connected to the Y direction driving mechanism of the embroidery device 30, as a parameter, the sewing area 38A is previously divided into the following three portions: a first area 38*a* that is a rectangle including the center OA of the embroidery frame 35A; a second area 38*b* made up of two small blocks on the left of the front and the rear of the area 38*a*; and a third area 38*c* which surrounds the right front, the right rear and right side of the first area 38*a*.

As shown in FIG. 4, a sewing area 38B in the small embroidery frame 35B is included in the first area 38*a* of the large embroidery frame 35A.

As the speed information, a standard sewing speed look-up table as shown in FIG. 5 and an adjustment value look-up table as shown in FIG. 6 are stored in the ROM 42. They both allow for the damping characteristic of the embroidery frame 35A. The sewing speed look-up table of FIG. 5 indicates standard sewing speeds N according to the stitch length for each stitch (that is the movement amount of the frame 35) which can be obtained from the sewing data. The adjustment value look-up table of FIG. 6 indicates reduction values in areas 38*a*, 38*b*, and 38*c*, relative to the standard sewing speed N. This is to decrease the sewing speed of the embroidery frame driving mechanism according to the distance from the reference point A. The sewing speed is determined from the above tables.

Figure 7:
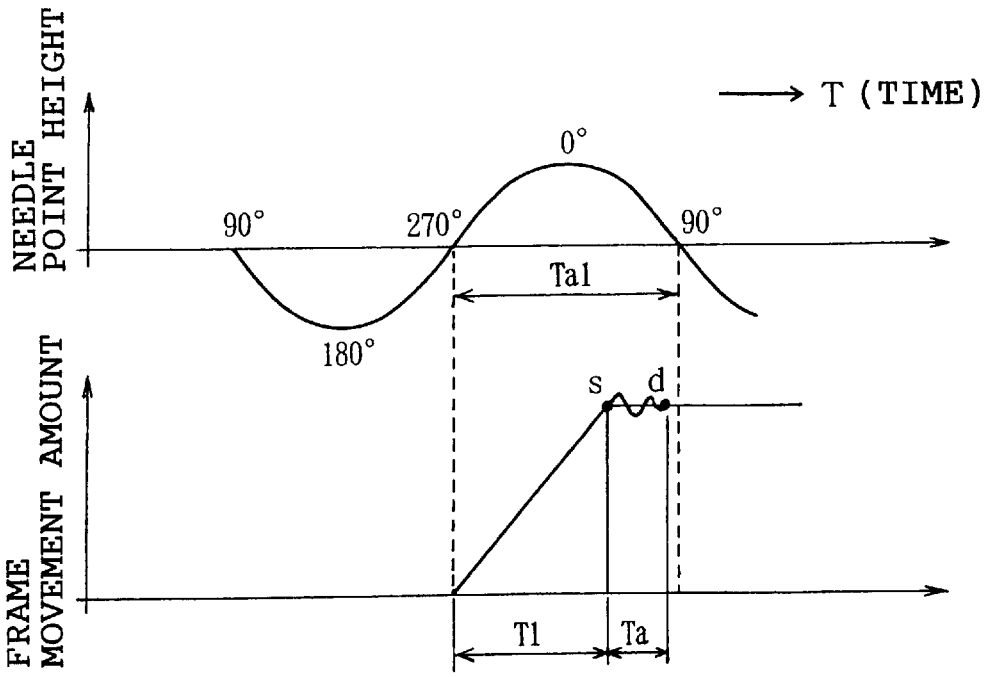
FIG. 7 is a time chart showing a correlation between the height of the needle point and the movement amount of the embroidery frame in a first area.
Figure 8:
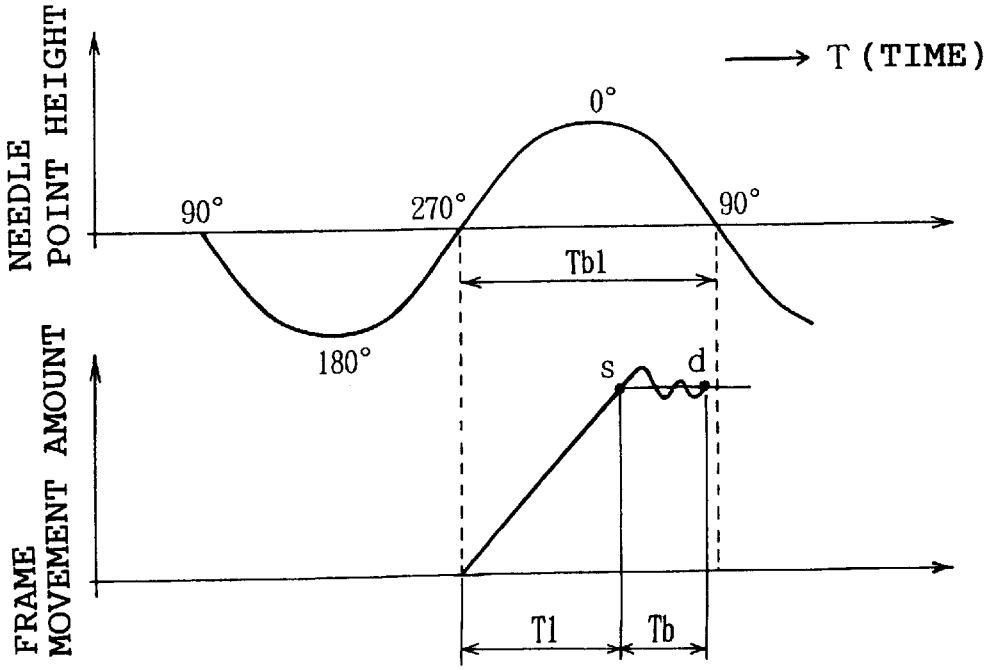
FIG. 8 is a time chart showing a correlation between the height of the needle point and the movement amount of the embroidery frame in second area.
Figure 9:
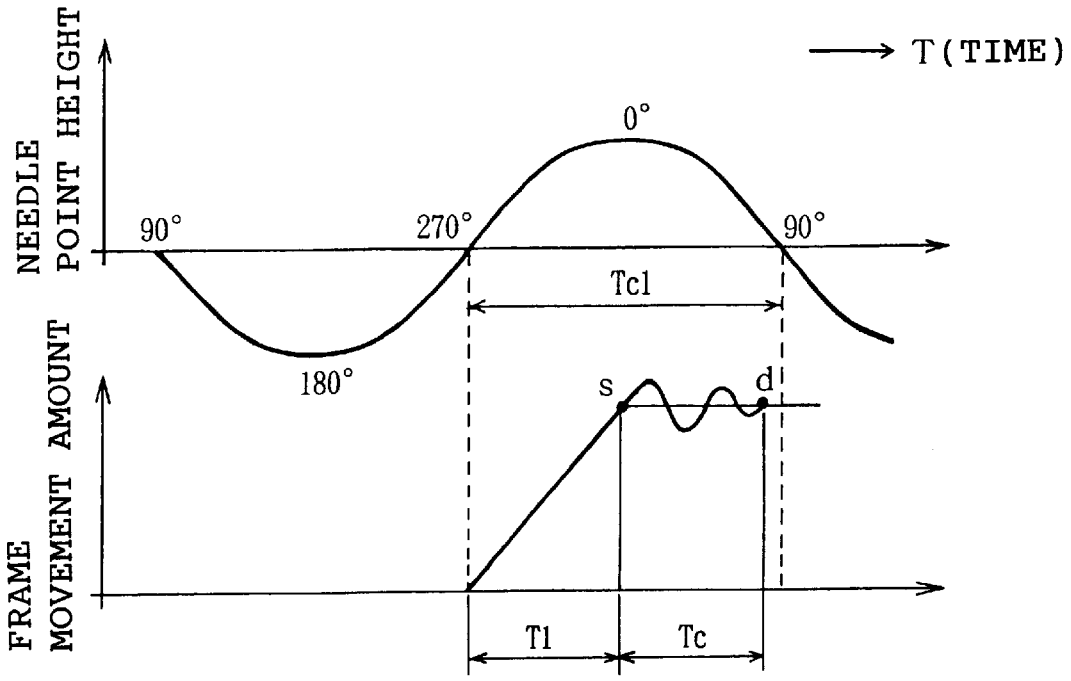
FIG. 9 is a time chart showing a correlation between the height of the needle point and the movement amount of the embroidery frame in third area.

Each of FIGS. 7 to 9 shows a timing chart between the height of the needle point and the movement amount of the embroidery frame 35A in each of areas 38*a* to 38*c* (for example, in a place where damping time is the longest) on the assumption that the movement amount of the frame 35A and the moving speed are fixed. The embroidery frame 35 is designed to start to move when the needle 11 comes out from the work cloth (phase: 270 degrees).

In the first area 38*a* shown in FIG. 7, the standard sewing speed N is determined from the stitch length indicated in the standard sewing speed look-up table of FIG. 5 so that time Ta1 at which the needle 11 is above the work cloth is slightly longer than a sum of time T1 in which the embroidery frame 35 moves and the time Ta in which the damping occurs (T1+Ta). Then, the sewing speed is determined as (N−0)=N rpm based on the adjustment value look-up table shown in FIG. 6. That is, the standard sewing speed N is used as the sewing speed. For example, when the stitch length is 3.2 mm, the sewing speed is determined as 500 rpm.

In the second area 38*b* shown in FIG. 8, the standard sewing speed N is determined from the stitch length indicated in the standard sewing speed look-up table of FIG. 5 so that damping time Tb becomes longer than damping time Ta in first area 38*a* and so that time Tb1 at which the needle 11 is above the work cloth is slightly longer than a sum of time T1 and time Tb (T1+Tb). Then the sewing speed is determined as (N-100) rpm based on the adjustment value look-up table shown in FIG. 6. For example, when the stitch length is 3.2 mm, the sewing speed is determined as (500−100)=400 rpm.

In the third area 38*c* shown in FIG. 9, the standard sewing speed N is determined from the stitch length indicated in the standard sewing speed look-up table of FIG. 5 so that damping time Tc becomes longer than damping time Tb in the second area 38*b* and so that time Tc1 at which the needle 11 is above the work cloth is slightly longer than a sum of time T1 and time Tc (T1+Tc). Then the sewing speed is determined as (N-200) rpm based on the adjustment value look-up table shown in FIG. 6. For example, when the stitch length is 3.2 nmm, the sewing speed is determined as (500−200)=300 rpm.

A series of routines related to embroidering control including the embroidery pattern selection process, the stitch point determining process, the speed determining process, and the speed control will be described with reference to flowcharts indicated in FIGS. 10 and 11. In the flowcharts, Si (i=1, 2, 3 . . . ) stands for a procedure step.

Figure 10:
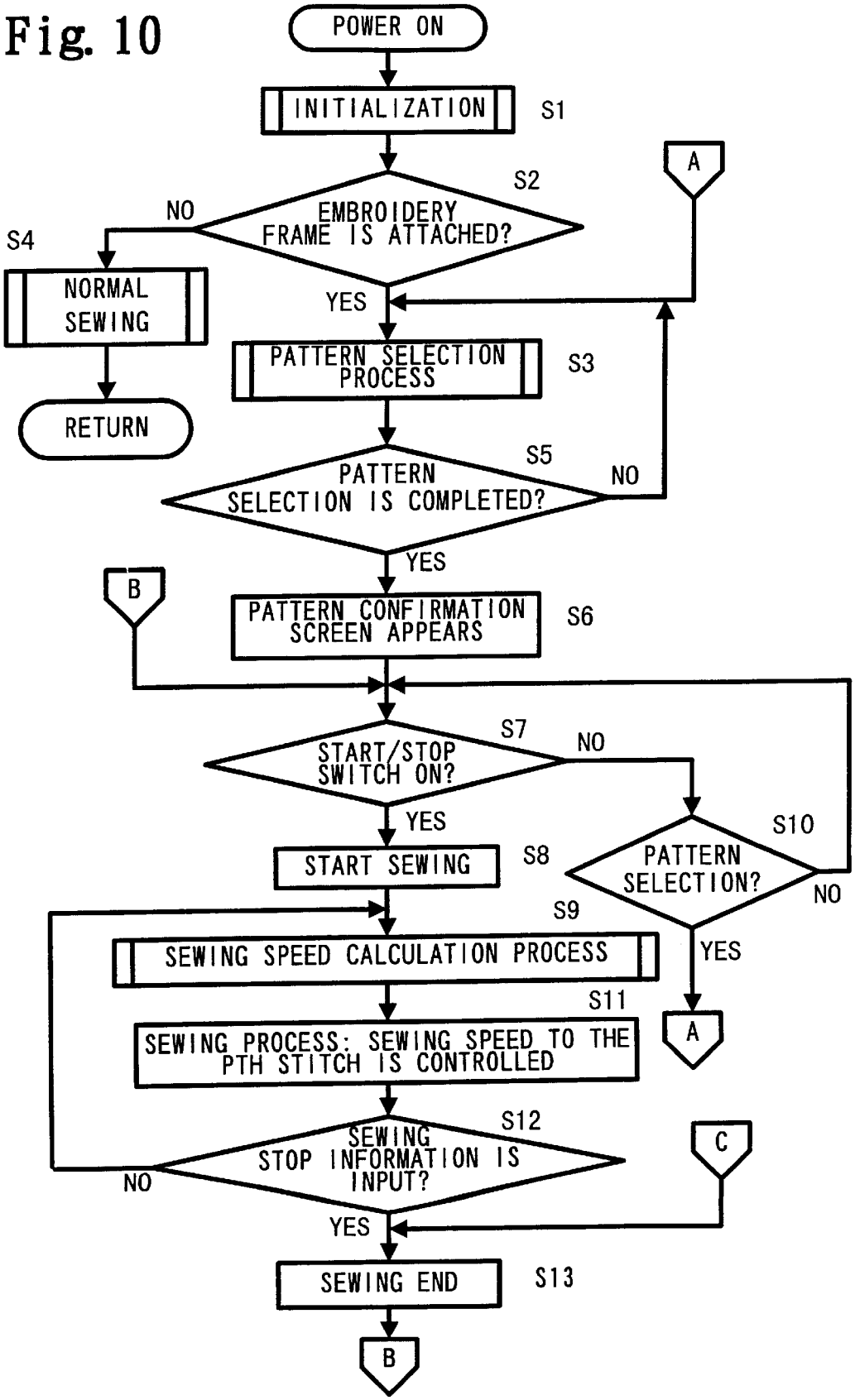
FIG. 10 is a flowchart showing a process of embroidering controls.

FIG. 10 shows the main routine of the embroidering control. When the power is turned on, the embroidering control starts. First, an initialization process, such as a process to clear each memory of the RAM 43, is performed (S1). When the embroidery device 30 is attached to the bed 1 (S2: Yes), an embroidery pattern selection process is executed (S3). When the embroidery device 30 is not attached to the bed 1 (S2: No), normal sewing is performed (S4).

Figure 12:
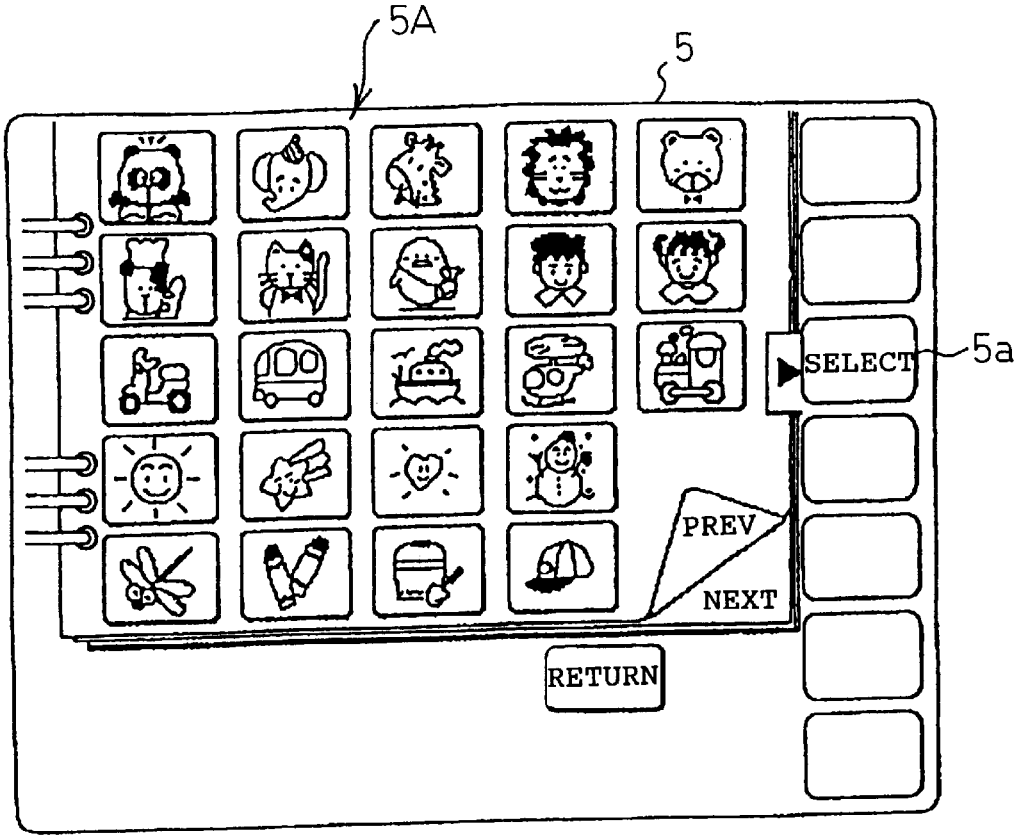
FIG. 12 shows a pattern selection screen.
Figure 13:
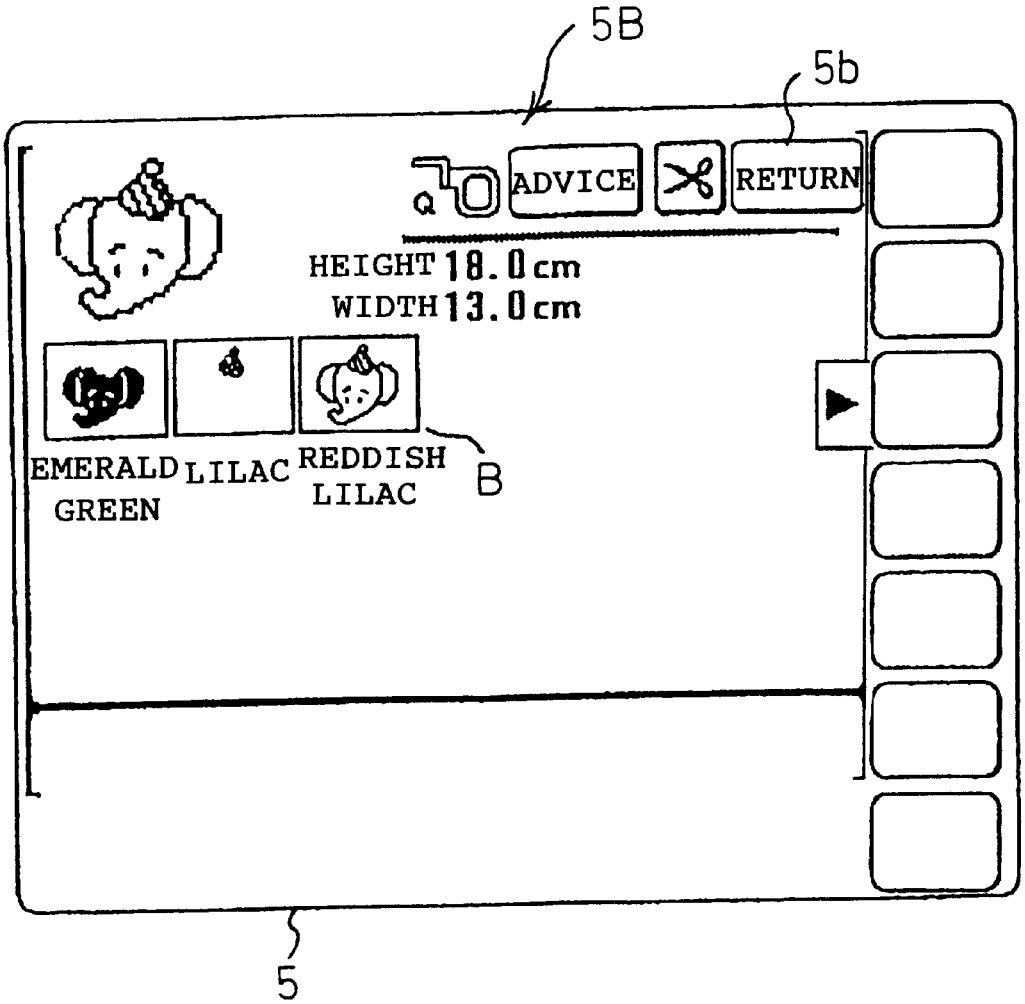
FIG. 13 shows a pattern confirmation screen.
Figure 14:
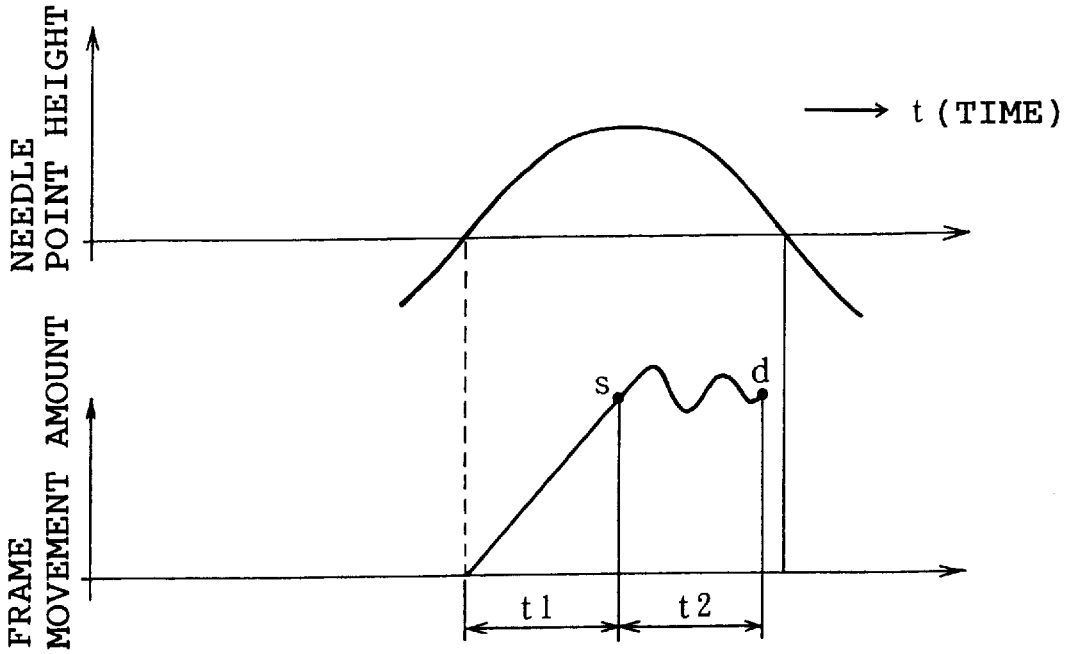
Fig.14 PRIOR ART
FIG. 14 is a time chart showing a correlation between the height of the needle point and the movement amount of the embroidery frame according to the prior art.
Figure 15:
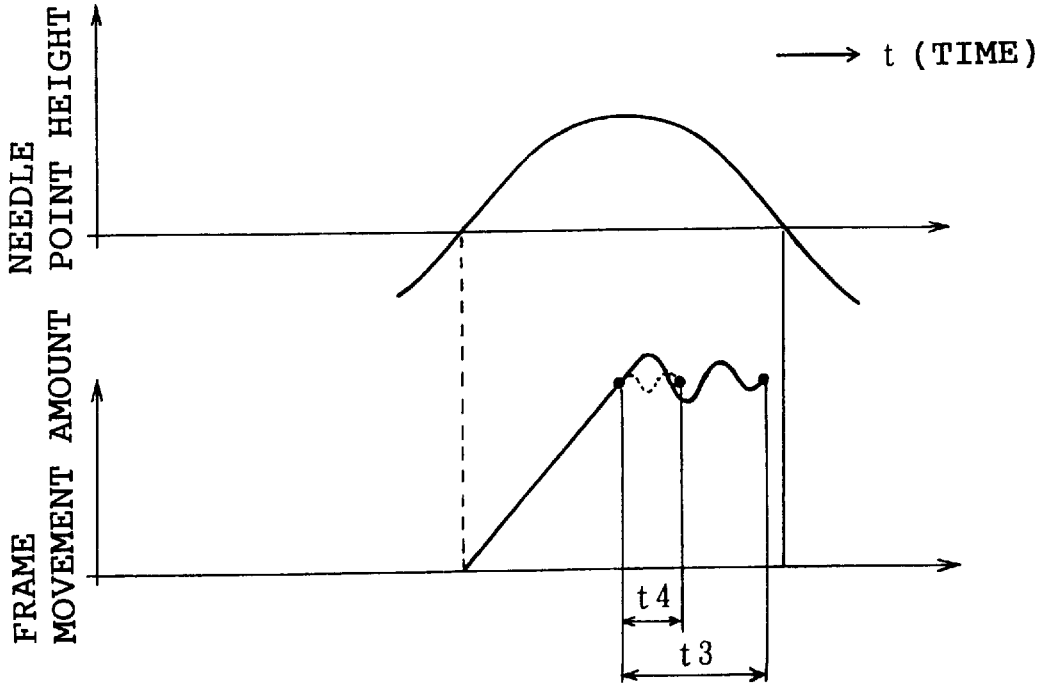
Fig.15 PRIOR ART
FIG. 15 is a time chart showing a correlation between the height of the needle point and the movement amount of the embroidery frame according to the prior art.

In the embroidery pattern selection process at S3, when a touch key 6 is pressed, for example, a pattern selection screen 5A as shown in FIG. 12 appears on the LCD 5. A desired pattern can be specified from many patterns with a touch on its image of the screen 5A, and selected with a touch of the select key 5*a*, as the pattern to be embroidered. When the pattern selection is completed (S5: Yes), for example, pattern "elephant" is selected, the LCD 5 displays the pattern confirmation screen 5B as shown in FIG. 13 (S6). The screen 5B shows the pattern "elephant" with its original full pattern and three partial patterns for embroidering different colors.

When the start/stop switch 15 is turned on (S7: Yes), the sewing operation is started (S8), and the sewing speed calculating process (89) is executed. On the contrary, when the start/stop switch 15 is not turned on (S7: No), and for example, the return key 5*b* is pressed on the pattern confirmation screen 5B, the CPU 41 determines that a pattern is selected (S10: Yes) and returns to S3 to execute pattern selection process.

Figure 11:
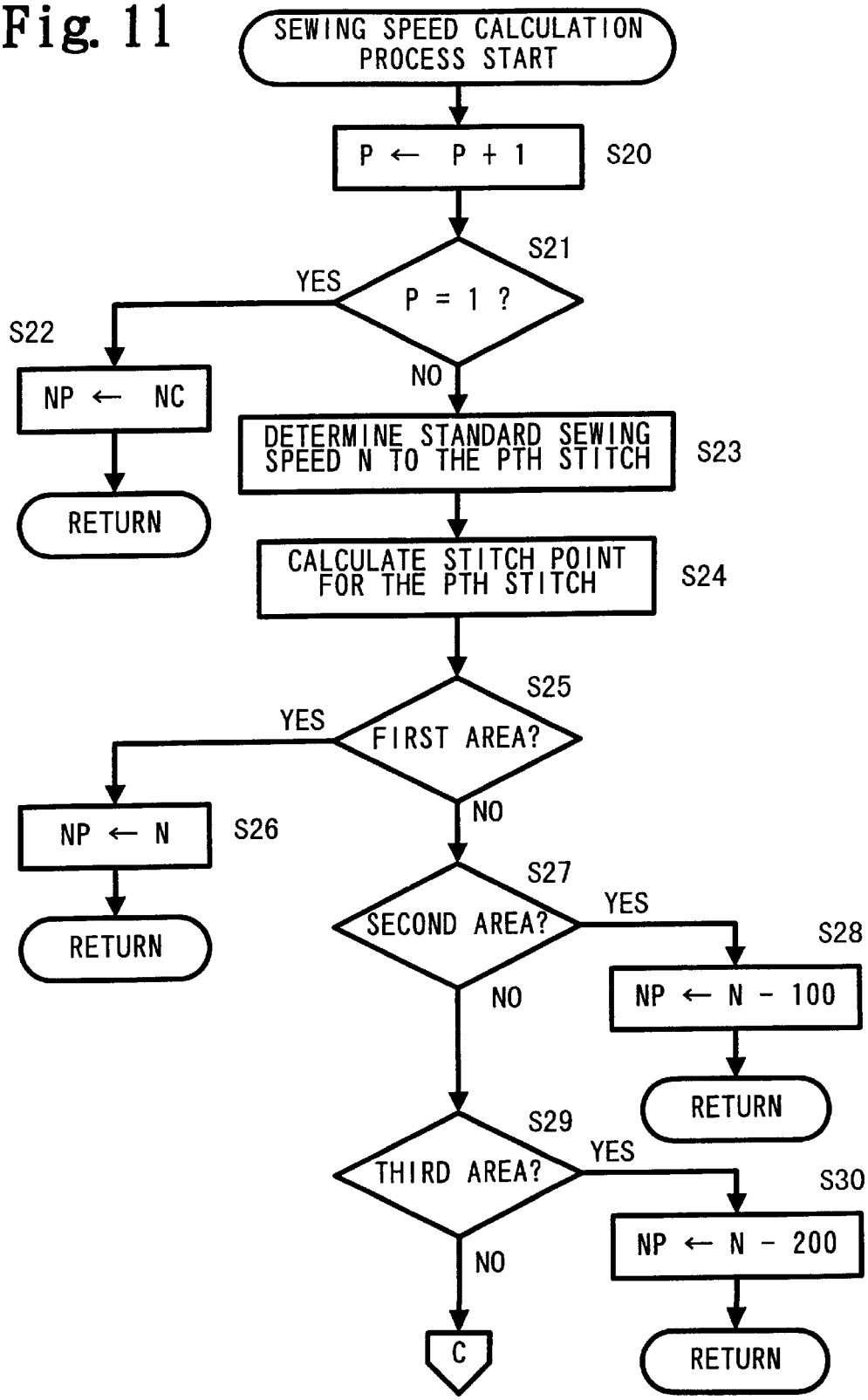
FIG. 11 is a flowchart of a sewing speed calculating process.

FIG. 11 shows a routine of the sewing speed calculating process (S9 in FIG. 10). When the speed calculating process is started, number P representing a stitch number, which is reset to 0 by initialization at S1, is increased (S20). When P is 1 (S21: Yes), a specified sewing start speed NC is set to the sewing speed NP (S22), and the procedure returns to the main routine. The first stitch is formed with the sewing start speed NC. However, the damping does not occur because the embroidery frame 35 is moved to the position where sewing is feasible in advance before the first stitch is made. Therefore, the sewing start speed NC is set to a predetermined initial speed in consideration of the sewing to be performed.

When P is not 1 (S21: No), the standard sewing speed N to the Pth stitch is set (S23). The standard sewing speed N to the Pth stitch is determined based on the stitch length from the (P−1)th stitch to the Pth stitch which is obtained from the sewing data and the standard sewing speed setting table of FIG. 5.

The stitch point for the Pth stitch is calculated based on the sewing data for the pattern to be embroidered (S24). In accordance with the adjustment value look-up table of FIG. 6, stored in the ROM 42, if the stitch point for the Pth stitch exists in first area 38*a* (S25: Yes), the sewing speed NP is fixed as N rpm (S26).

If the stitch point for the Pth stitch exists in the second area 38*b* (S25: No, S27: Yes), the sewing speed NP is fixed as (N-100) rpm (S28). If the stitch point for the Pth stitch exists in the third area 38*c* (S25: No, S27: No, S29: Yes), the sewing speed NP is fixed as (N-200) rpm (S30). After that, the procedure returns to the main routine of FIG. 10 in both cases.

If the stitch point for the Pth stitch exists nowhere in first area 38*a*, the second area 38*b*, or the third area 38*c* (S25: No, S27: No, S29: No), the CPU 41 determines the sewing is impossible, and returns to S13 to stop sewing. A step S24 functions as a calculating device, and steps S23 and S25–S30 function as a speed determination device.

Then, as shown in FIG. 10, the sewing is executed (S11). The X and Y direction driving mechanisms of the embroidery device 30 are driven and controlled based on the sewing data, and simultaneously the sewing speed to the Pth stitch is controlled so that it becomes the sewing speed NP that is found at the speed calculating process. After that, when the sewing stop information is input (S12), for example, the sewing stop code is input or the start/stop switch 15 is pressed, the sewing is stopped (S13) and the CPU 41 returns to step S7.

According to the sewing machine M, the ROM 42 previously stores information on the sewing speeds of the stitch formation device in each of the areas 38*a*, 38*b*, and 38*c* which are split from the sewing area 38A in the embroidery frame 35. From the information, the CPU 41 calculates a stitch point for each stitch based on the sewing data, and determines in which of the first area 38*a*, the second area 38*b*, or the third area 38*c* the stitch point is placed. Thus, the sewing speed of the stitch formation device can be set based on the position of the stitch point and the information on the sewing speeds stored in the ROM 42.

In other words, the sewing speed for each stitch created by the stitch formation device can be set as fast as possible so that while the needle 11 is above the work cloth, the embroidery frame 35 can be moved for a stitch and the damping is substantially settled. Thus, the quality of sewing can be secured and the entire sewing speed can be increased, thereby reducing the sewing time.

The sewing area 38A in the embroidery frame 35A is previously divided into areas 38*a*, 38*b*, and 38*c*, using the distance from the reference point A in the connecting portion 37A, which connects the embroidery frame 35A and the embroidery frame driving device, as a parameter. Through this division, the damping time lag is minimized. Therefore, the sewing speed in each of areas 38*a*, 38*b*, and 38*c* can be determined appropriately so that the quality of sewing can be secured and the entire sewing speed can be increased.

The ROM 42 stores the standard sewing speed look-up table of FIG. 5 as the speed information, so that the longer the distance between the reference point A in the connecting portion 37A and each of areas 38*a*, 38*b*, and 38*c* is, the lower the sewing speed of the embroidery frame driving device becomes. Therefore, the sewing speed in each of areas 38*a*, 38*b*, and 38*c* can be set easily and securely as fast as possible while maintaining the quality of sewing.

The following are some modifications of the embodiment:

The set values in the standard sewing speed look-up table of FIG. 5 and the adjustment value look-up table of FIG. 6 take into account the damping characteristic of the embroidery frame 35A determined experimentally and theoretically, and the sewing ability of the sewing machine M. When other embroidery frames are used, the values can be set based on the damping characteristic of each frame. If the moving speed of the embroidery frame can be changed appropriately, it is possible to prepare a plurality of the standard sewing speed look-up tables and the adjustment value look-up tables according to the moving speed or to determine the standard sewing speed and the actual sewing speed by correcting the standard moving speed as necessary.

The sewing speed of the (P+n)th stitch, which is the nth stitch (e.g. n=5 to 10) ahead of the Pth stitch currently sewn, can be calculated beforehand. This enables speed control of the stitch formation mechanism so that the sewing speed to the (Ptn)th stitch can be performed as calculated.

Although the sewing speed is determined for every stitch point, the sewing speed may be determined for groups of stitches consisting of a predetermined number of stitch points. The predetermined number, for example, may be defined to five or six. First, speed data for the predetermined number of stitch points may be calculated. Then, the sewing speed for sewing the group of stitches can be determined by the minimum value among the predetermined number of speed data.

Therefore, as the sewing speed is determined every predetermined number of stitches, the stitch formation device can follow the change of the speed. Further, as the speed of the stitch formation device is not changed too frequently, the stitch formation device can perform sewing smoothly at the specified speed.

Further, although the sewing area 38A has been shown divided into a plurality of areas, as shown in FIG. 3, it should be appreciated that the dividing method is not restricted to the embodiment. For example, the sewing area 38A can be partitioned with one or more parting lines which are concentrically extended from the reference point A.

For another exemplary embodiment, the sewing area 38A of the frame 35 is not divided into the areas 38*a*, 38*b*, and 38*c*, rather the distance from the reference point A in the part 37A connected to the embroidery frame driving device of the embroidery frame 35A to the stitch point can be calculated based on the sewing data for the pattern to be embroidered, and the sewing speed can be set so that the sewing speed decreases as the distance increases and increases as the distance decreases.

For example, the sewing speed NP may be determined by using a following formula and the standard sewing speed look-up table of FIG. 5 without using the adjustment value look-up table of FIG. 6.

$$NP=N-D\times K$$

Where N is a standard speed, D is a distance between the point A and each stitch point, and K is a modulus which is experimentally determined so that the damping by the movement of the embroidery frame is settled.

Further, although the programs and the look-up tables for practicing the invention are stored in the ROM 42 in the aforementioned embodiment, they may be stored in a rewritable non-volatile storing device, such as a flash memory. In this embodiment, the programs and the look-up tables may be read from a floppy disk storing the program and the look-up tables therein into the rewritable non-volatile storing device. Further, the programs and the look-up tables may be downloaded to the rewritable non-volatile storing device through a computer network.

While the invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A sewing machine for forming a pattern on a work cloth, comprising:

a stitch formation device that forms a stitch on the work cloth;

a work holder that holds the work cloth;

a work holder driving device that holds the work holder at one end and moves the work holder in two different directions, the work holder being detachably attached to the work holder driving device on a connecting portion thereof;

a calculating device that calculates a distance between the connecting portion and a stitch point based on sewing data;

a speed determination device that determines a sewing speed of the stitch formation device; and a speed controller that controls the stitch formation device based on the sewing speed determined by the speed determination device.

2. The sewing machine according to claim 1, wherein the speed determination device calculates speed data for a predetermined number of stitch points and determines the sewing speed for the predetermined number of stitch points by the minimum value among a predetermined number of speed data.

3. The sewing machine according to claim 1, wherein the sewing speed increases as the distance decreases and the sewing speed decreases as the distance increases.

4. A sewing machine for forming a pattern on a work cloth, comprising:

a stitch formation device that forms a stitch;

a work holder that holds the work cloth;

a work holder driving device that holds the work holder at one end and moves the work holder in two different directions, the work holder being detachably attached to the work holder driving device on a connecting portion thereof; and a speed determination device that determines a sewing speed of the stitch formation device by determining which divided sewing area includes a stitch point, each divided sewing area being divided out from a whole sewing area surrounded by the work holder; and a controller that controls the stitch formation device based on the sewing speed determined by the speed determination device.

5. The sewing machine according to claim 4, further comprising an adjustment value obtaining device that obtains an adjustment value determined for each divided sewing area; wherein the speed determination device determines the sewing speed based on a standard sewing speed and the adjustment value.

6. The sewing machine according to claim 5, further comprising a standard speed obtaining device that obtains the standard sewing speed determined by a stitch length.

7. The sewing machine according to claim 5, wherein the adjustment value is set so that the sewing speed decreases as a distance between each divided sewing area and the connecting portion increases and the sewing speed increases as the distance decreases.

8. The sewing machine according to claim 5, wherein the speed determination device determines the sewing speed by subtracting the adjustment value from the standard sewing speed.

9. The sewing machine according to claim 4, wherein each divided sewing area is divided out from the whole sewing area based on a distance from the connecting portion.

10. The sewing machine according to claim 4, wherein the speed determination device calculates speed data for a predetermined number of stitch points and determines the sewing speed for the predetermined number of stitch points by the minimum value among the predetermined number of speed data.

11. A method of controlling a stitch formation device of a sewing machine that forms a pattern on a work cloth held in a work holder detachably attached to the sewing machine on a connecting portion thereof, comprising:

moving the work holder in two different directions;

calculating a distance between the connecting portion and a stitch point; and determining a sewing speed of the stitch formation device; and controlling the stitch formation device based on the determined sewing speed.

12. The method according to claim 11, wherein determining the sewing speed of the stitch formation device comprises:

calculating speed data for a predetermined number of stitch points; and determining the sewing speed for the predetermined number of stitch points by the minimum value among the predetermined number of speed data.

13. The method according to claim 11, further comprising:

increasing the sewing speed as the distance decreases; and decreasing the sewing speed as the distance increases.

14. A method of controlling a stitch formation device of a sewing machine that forms a pattern on a work cloth held in a work holder detachably attached to the sewing machine on a connecting portion thereof, comprising:

dividing a whole sewing area surrounded by the work holder into a plurality of divided sewing areas;

moving the work holder in two different directions;

determining a sewing speed of the stitch formation device by determining which divided sewing area includes a stitch point; and controlling the stitch formation device based on the determined sewing speed.

15. The method of claim 14, further comprising;

obtaining an adjustment value determined for each divided sewing area; and determining the sewing speed based on a standard sewing speed and the adjustment value.

16. The method of claim 15, further comprising obtaining the standard sewing speed based on a stitch length.

17. The method of claim 15, wherein the adjustment value is set so that the sewing speed decreases as a distance between each divided sewing area and the connecting portion increases and the sewing speed increases as the distance decreases.

18. The method of claim 15, wherein determining the sewing speed comprises subtracting the adjustment value from the standard sewing speed.

19. The method of claim 14, wherein each divided sewing area is divided out from the whole sewing area based on a distance from the connecting portion.

20. The method of claim 14, further comprising:

calculating speed data for a predetermined number of stitch points; and determining the sewing speed for the predetermined number of stitch points by the minimum value among the predetermined number of speed data.

21. A memory medium containing routines for controlling a stitch formation device of a sewing machine that forms a pattern on a work cloth held in a work holder detachably attached to the sewing machine on a connecting portion thereof, comprising:

a routine for moving the work holder in two different directions;

a routine for calculating a distance between the connecting portion and a stitch point;

a routine for determining a sewing speed of the stitch formation device; and a routine for controlling the stitch formation device based on the determined sewing speed.

22. The memory medium according to claim 21, wherein the routine for determining the sewing speed of the stitch formation device comprises:

a routine for calculating speed data for a predetermined number of stitch points; and a routine for determining the sewing speed for the predetermined number of stitch points by the minimum value among the predetermined number of speed data.

23. The memory medium according to claim 21, further comprising:

a routine for increasing the sewing speed as the distance decreases and decreasing the sewing speed as the distance increases.

24. A memory medium containing routines for controlling a stitch formation device of a sewing machine that forms a pattern on a work cloth held in a work holder detachably attached to the sewing machine on a connecting portion thereof, comprising:

a routine for moving the work holder in two different directions;

a routine for determining a sewing speed of the stitch formation device by determining which divided sewing area includes a stitch point, each divided sewing area being divided out from a whole sewing area surrounded by the work holder; and a routine for controlling the stitch formation device based on the determined sewing speed.

25. The memory medium of claim 24, further comprising;

a routine for obtaining an adjustment value determined for each divided sewing area; and a routine for determining the sewing speed based on a standard sewing speed and the adjustment value.

26. The memory medium of claim 25, further comprising a routine for obtaining the standard sewing speed based on a stitch length.

27. The memory medium of claim 25, wherein the adjustment value is set so that the sewing speed decreases as a distance between each divided sewing area and the connecting portion increases and the sewing speed increases as the distance decreases.

28. The memory medium of claim 25, wherein the routine for determining the sewing speed comprises a routine for subtracting the adjustment value from the standard sewing speed.

29. The memory medium of claim 24, wherein each divided sewing area is divided out from the whole sewing area based on a distance from the connecting portion.

30. The method of claim 24, further comprising:

a routine for calculating speed data for a predetermined number of stitch points; and a routine for determining the sewing speed for the predetermined number of stitch points by the minimum value among the predetermined number of speed data.

* * * * *